US006409484B1

(12) United States Patent
Hyun

(10) Patent No.: US 6,409,484 B1
(45) Date of Patent: Jun. 25, 2002

(54) OIL SUPPLY UNIT OF LINEAR COMPRESSOR

(75) Inventor: Seong Yeol Hyun, Changwon (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 09/623,009

(22) PCT Filed: Dec. 27, 1999

(86) PCT No.: PCT/KR99/00821

§ 371 (c)(1),
(2), (4) Date: Aug. 24, 2000

(87) PCT Pub. No.: WO00/39461

PCT Pub. Date: Jul. 6, 2000

(30) Foreign Application Priority Data

Dec. 28, 1998 (KR) ..... 99-59383

(51) Int. Cl.[7] ..... F04B 17/04

(52) U.S. Cl. ..... 417/417; 417/372; 417/569; 184/32

(58) Field of Search ..... 417/372, 417, 417/567, 569; 184/32, 6.16

(56) References Cited

U.S. PATENT DOCUMENTS 5,993,175 A * 11/1999 Kim et al. ..... 417/417
6,089,352 A * 7/2000 Kim et al. ..... 184/6.16
6,220,393 B1 * 4/2001 Oh et al. ..... 184/6.16

FOREIGN PATENT DOCUMENTS

JP 56-13557 2/1981
JP 56-129780 10/1981
JP 59-218369 12/1984
JP 9-195938 A * 7/1997 ..... 184/6.16

* cited by examiner

*Primary Examiner*—Charles G. Freay
*Assistant Examiner*—Michael K. Gray
(74) *Attorney, Agent, or Firm*—Ostrolenk, Faber, Gerb & Soffen, LLP

(57) ABSTRACT

An oil supply unit of a linear compressor including: a well-closed container filled with oil; a frame installed within the well-closed container; a cylinder fixed at the frame; a piston inserted, in the cylinder and being linearly and reciprocally moved by a linear motor; an oil cylinder fixed at the lower portion of the frame so as to be put in the oil filling the well-closed container, and being vibrated in the horizontal direction according to the reciprocal movement of the piston; an oil piston inserted in the oil cylinder in a manner of dividing the inside of the oil cylinder to a suction space and a discharge space that are communicated to each other, and being vibrated in the horizontal direction; an oil suction installed at the outer side of the suction side of the oil cylinder, for opening and closing the suction side of the oil cylinder; an oil discharge valve installed at the outer side of the discharging side of the oil cylinder, for opening and closing the discharging side of the oil cylinder; an oil suction cover for covering the suction side of the oil cylinder and having the oil suction valve inside thereof; and an oil discharge cover forming an oil inlet passage along with the frame, opening the discharging side of the oil cylinder, and having the oil discharge valve inside thereof.

10 Claims, 8 Drawing Sheets

OIL SUPPLY UNIT OF LINEAR COMPRESSOR

TECHNICAL FIELD

The present invention relates to an oil supply unit of a linear compressor, and more particularly, to an oil supply unit of a linear compressor which is capable of facilitating fabricating and assembling an oil suction valve.

BACKGROUND ART

As is known, a linear compressor is an equipment for compressing a coolant by directly moving reciprocally by means of a magnet and a coil instead of a crank shaft.

FIG. 1 shows a general linear compressor in accordance with a conventional art. As shown in the drawing, the linear compressor includes a compressive unit 'C' installed in a well-closed container 'V' filled with oil at its bottom in the horizontal direction for sucking, compressing and discharging a coolant, and an oil supply unit 'O' fixed at an outside of the compressive unit 'C' for supplying oil to friction portions of construction elements.

The construction of the compressive unit 'C' will now be described in detail.

The compressive unit 'C' includes a frame 1 installed inside the well-closed container 'V', a cylinder 2 inserted into a through hole formed at the central portion of the frame 1, a piston 3 inserted inside the cylinder and for being moved linearly and reciprocally by the driving of a linear motor, and a discharge cover 5 having a discharge valve 4 that opens and closes the cylinder 2 according to the reciprocal movement of the piston 3, and combined to one side of the cylinder 2 to be opened.

A first oil pocket 1*b* is formed at the inner circumferential surface of the through hole of the frame 1, communicating with the discharging side of the oil supply unit 'O' by an oil inlet passage 1*a*. A second oil pocket 3*a* is formed at the outer circumferential surface of the piston 3. An oil through hole 2*a* is formed at the cylinder 2, rendering the first oil pocket 1*b* to be communicated with the second oil pocket 3*a*.

An oil circulation path 1*d* is formed at the uppermost portion of the first oil pocket 1*b* by the outer circumferential surface of the cylinder 2, the through hole of the frame 1 and the discharge cover 5, communicating with an oil communicating path 1*c*. An oil discharge hole 1*e* is formed at the lowermost portion of the oil circulating path 1*d*, to return the oil that circulated through the oil circulating path 1*d* to the well-closed container 'V'.

The construction of the oil supply unit 'O' will now be described in detail.

FIG. 2 is a vertical-sectional view of the oil supply unit of the linear compressor in accordance with the conventional art. FIG. 3A is a plan view of an oil suction valve of the oil supply unit of the linear compressor in accordance with the conventional art, and FIG. 3B is a plan view of an oil discharge valve of the oil supply unit of the linear compressor in accordance with the conventional art.

As shown in the drawings, the oil supply unit 'O' includes an oil cylinder 21 attached at the bottom of the compressive unit 'C', an oil piston 22 inserted into the oil cylinder 21, dividing the inside of the oil cylinder 21 to a suction space S1 and a discharge space S2, a first and a second oil springs 23A and 23B of which each one end elastically support both ends of the oil piston against the oil cylinder 21, an oil suction cover 24 and an oil discharge cover 25 for respectively supporting each other end of the first and the second oil springs 23A and 23B, and respectively fixing the both ends of the oil cylinder 21 to the compressive unit 'C', an oil suction valve 26 positioned between the outlet of the oil piston 22 and the one end portion of the second oil spring 23B, to be supported by the second oil spring 23B, and an oil discharge valve 27 positioned at one side of the other end portion of the second oil spring 23B and being mounted inside the oil discharge cover 25.

The oil piston 22 is inserted in a manner that is outer circumferential surface slidably contacts the inner circumferential surface of the oil cylinder 21, and an oil passage 22*a* is penetratingly formed in the lengthy direction at its inner central portion.

In a spiral form, the oil suction valve 26 is inserted in the oil cylinder 21 and tightly supported by the second oil spring 23B at the outlet portion of the oil piston 22. Meanwhile, in a rectangular form, the oil discharge valve 27 is adhered at the outer surface of the discharging side of the oil cylinder 21, being supported by the oil discharge cover 25.

Reference numeral 6 denotes a stator assembly a stator, and reference numeral 7 denotes a magnet assembly, a rotor, 8 denotes a cover, 9 denotes a main spring, and 10 denotes a suction pipe.

The operation of the oil supply unit of the linear compressor of the conventional art constructed as described above will now be explained.

The compressive unit 'C' is vibrated in the horizontal direction along with the magnet assembly according to the linear reciprocal movement of the magnet assembly 7, the rotor of the linear motor, and the vibration is transferred to the oil supply unit 'O' fixed at the compressive unit 'C', rendering the oil supply unit 'O' to move reciprocally. At this time, the oil piston 22 is slidably inserted to the oil cylinder, so that the oil is sucked and discharged by the inertial force corresponding to the reciprocal movement of the oil cylinder 21.

The thusly pumped oil by the oil supply unit 'O' is induced to the first oil pocket 1*b* through the oil inlet passage 1*a* and then induced to the second oil pocket 3*a* through the oil through hole 2*a*, cooling the heat generated at the outer circumferential surface of the cylinder 2 and the heat generated at the linear motor and lubricating the sliding portion between the cylinder 2 and the piston 3. And then, the oil is induced to the oil circulating path 1*d* through the first oil pocket 1*b* and the oil communicating path 1*c*, which is circulated the cylinder 2 and the discharge cover 4, while cooling it, and then returns to the well-closed container 'V' through the oil discharge hole 1*e*.

The operation that the oil supply unit 'O' pumps the oil will now be described with reference to FIGS. 4A and 4B.

First, when the oil cylinder 21 is moved in the 'A' direction of FIG. 4A, resultantly, the oil piston 22 is moved in the 'B' direction, so that the oil that filled the discharge space 'S2' is pushed toward the oil discharge cover 25 while oil is induced to the suction space 'S1' to be filled.

At this time, the oil suction valve 26 is closed, closing the oil passage 22*a* of the oil piston 22, while the oil discharge valve 27 is pulled back in the 'B' direction, opening the discharging side of the oil cylinder 21.

Reversely, in case that the oil cylinder 21 is moved in the 'B' direction of Figure B, resultantly, the oil piston 22 is moved in the 'A' direction, so that the pressure of the discharge space 'S2' becomes relatively low compared to that of the suction space 'S1', rendering the oil of the suction space 'S1' to be moved to the discharge space 'S2'.

At this time, the first oil spring 23A is compressed while the second oil spring 23B is extended, and the oil suction valve 26 is opened while the oil discharge valve 27 is rotated in the 'A' direction to close the discharging side of the oil cylinder 21 to thereby prevent backflow of the oil.

However, as to the oil supply unit of the conventional linear compressor, since the oil suction valve controlling the inlet and outlet of the oil is made small to be mounted within the cylinder having small diameter, its fabrication and assembling is not easy.

DISCLOSURE OF THE INVENTION

Therefore, it is an object of the present invention to provide an oil supply unit of a linear compressor which is capable of improving a productivity by facilitating fabrication and assembling of a valve that controls inlet and outlet of oil.

In order to achieve the above object, there is provided an oil supply unit of a linear compressor including: a well-closed container filled with oil; a frame installed within the well-closed container; a cylinder fixed at the frame; a piston inserted in the cylinder and being linearly and reciprocally moved by a linear motor; an oil cylinder fixed at the lower portion of the frame so as to be put in the oil filling the well-closed container, and being vibrated in the horizontal direction according to the reciprocal movement of the piston; an oil piston inserted in the oil cylinder in a manner of dividing the inside of the oil cylinder to a suction space and a discharge space that are communicated to each other, and being vibrated in the horizontal direction; an oil suction valve installed at the outer side of the suction side of the oil cylinder, for opening and closing the suction side of the oil cylinder; an oil discharge valve installed at the outer side of the discharging side of the oil cylinder, for opening and closing the discharging side of the oil cylinder: an oil suction cover for covering the suction side of the oil cylinder and having the oil suction valve inside thereof; and an oil discharge cover forming an oil inlet passage along with the frame, opening the discharging side of the oil cylinder, and having the oil discharge valve inside thereof.

MODES FOR CARRYING OUT THE PREFERRED EMBODIMENTS

The oil supply unit of a linear compressor in accordance with the present invention will now be described with reference to the accompanying drawings.

Figure 1:
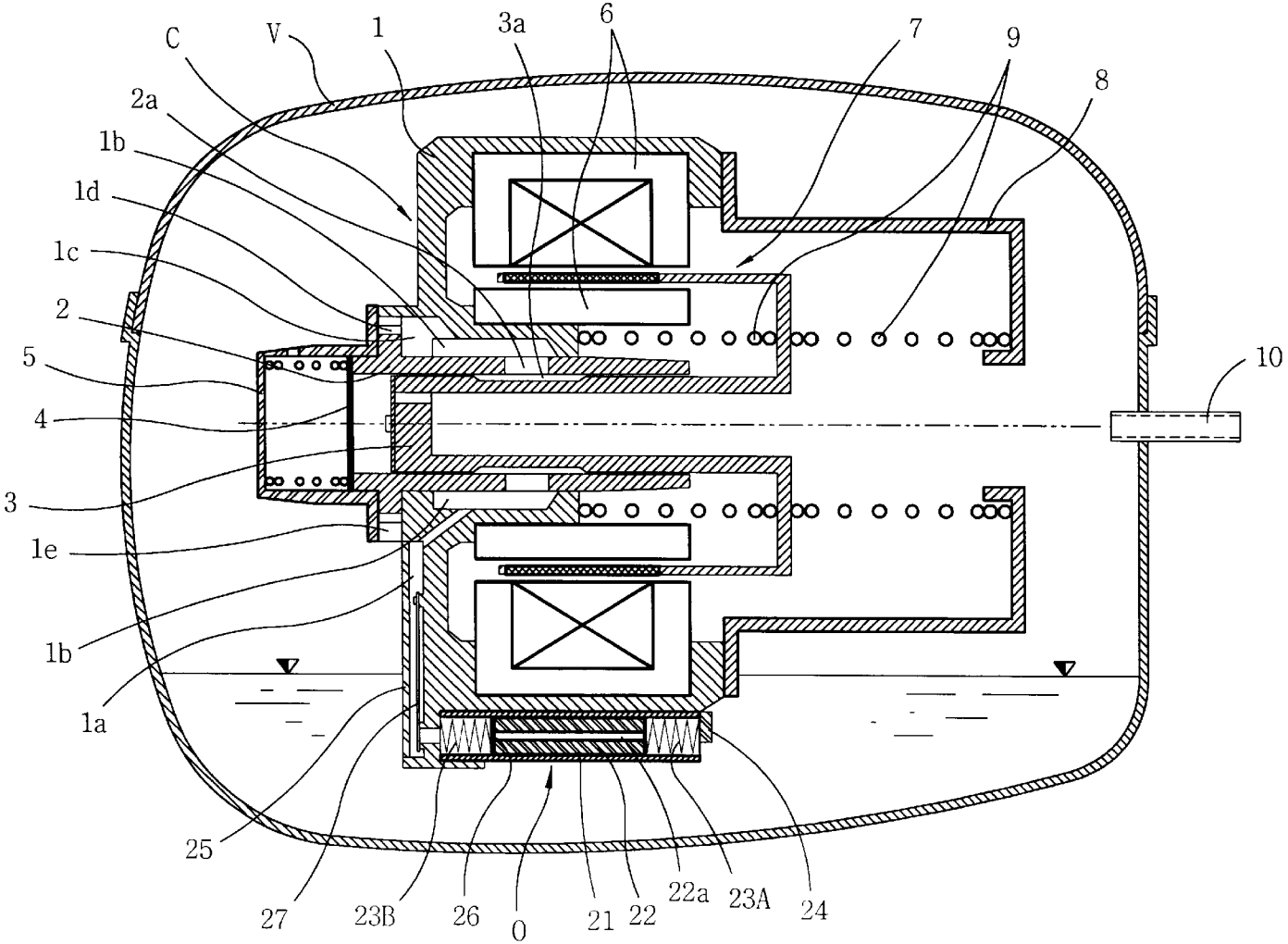
FIG. 1 CONVENTIONAL ART
FIG. 1 is a vertical-sectional view of a general linear compressor in accordance with a conventional art.
Figure 2:
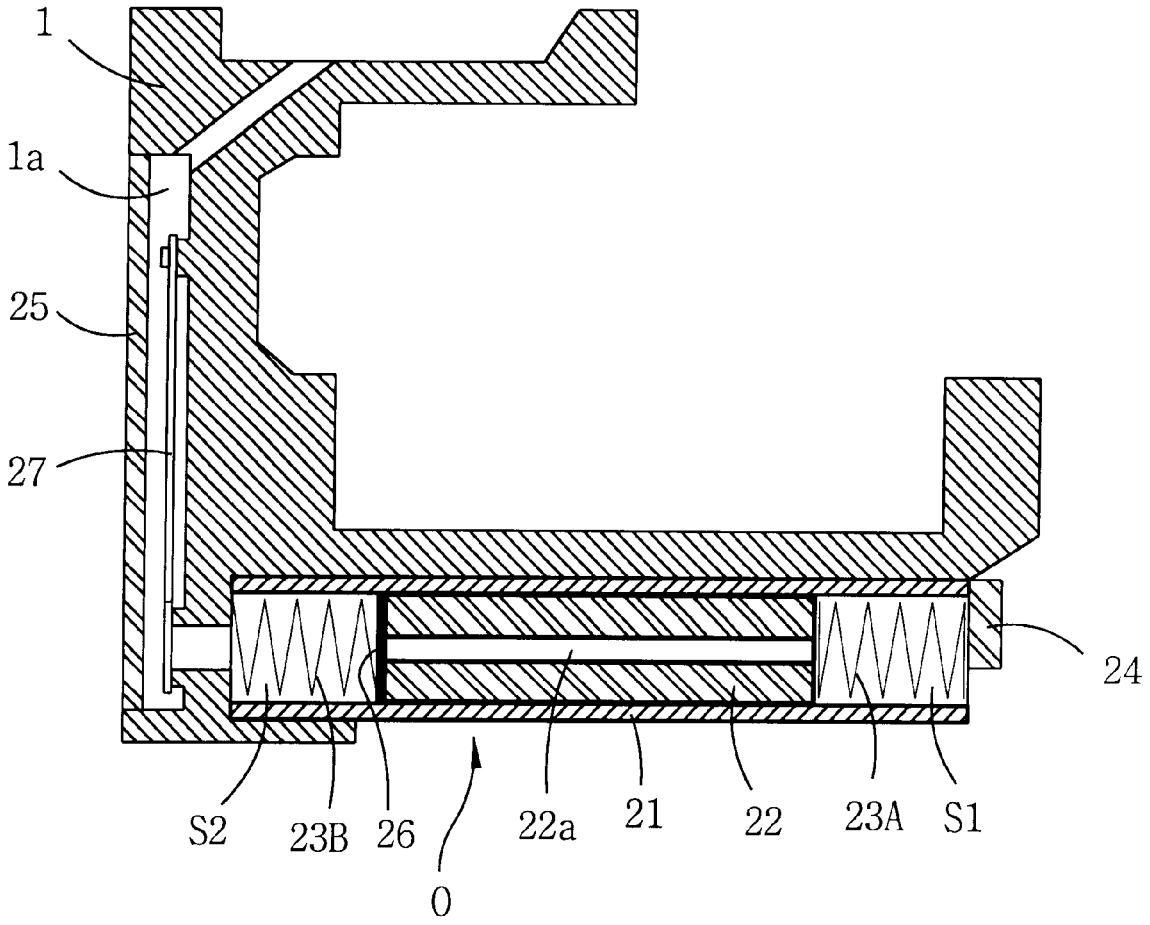
FIG. 2 CONVENTIONAL ART
FIG. 2 is a vertical-sectional view of an oil supply unit of a linear compressor in accordance with the conventional art.
Figure 3A:
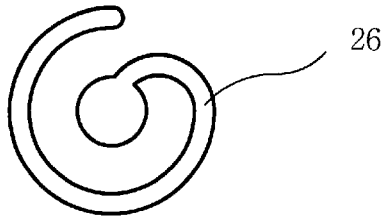
FIG. 3A CONVENTIONAL ART
FIG. 3A is a plan view of an oil suction valve of the oil supply unit in accordance with the conventional art.
Figure 3B:
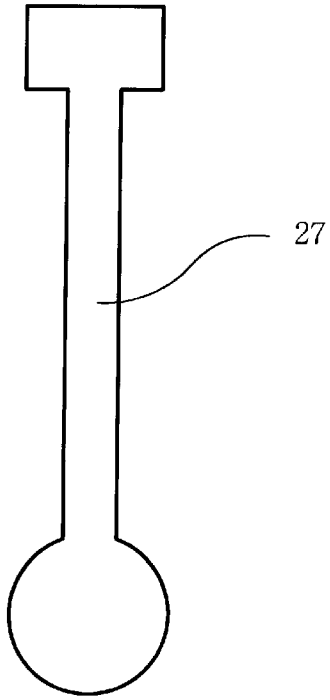
FIG. 3B CONVENTIONAL ART
FIG. 3B is a plan view of an oil discharge valve of the oil supply unit in accordance with the conventional art.
Figure 4A:
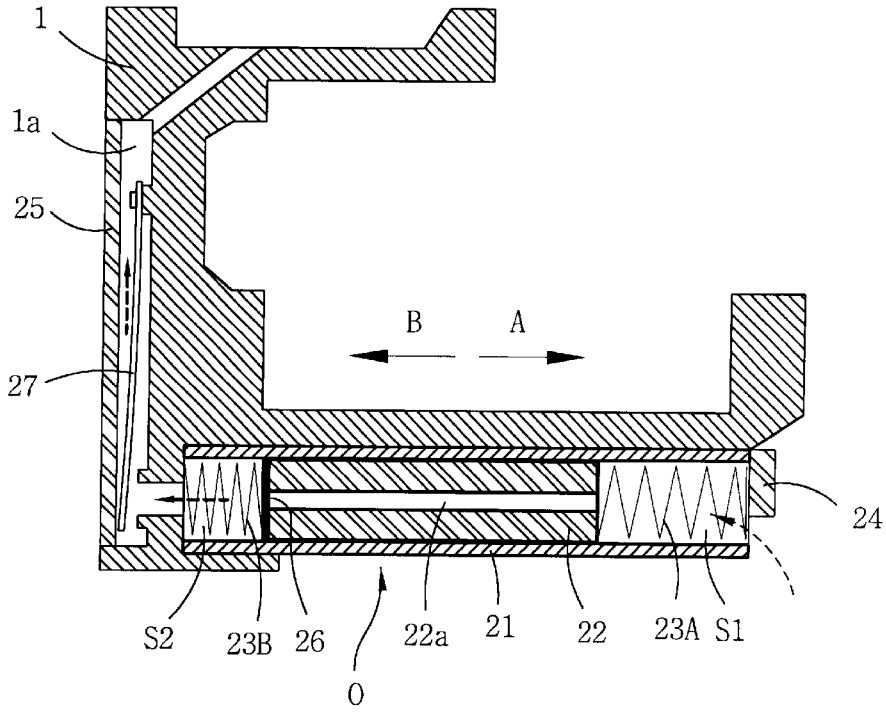
FIG. 4A CONVENTIONAL ART
FIG. 4A is a vertical-sectional view showing an operation of the oil supply unit that an oil piston is moved toward an oil discharge cover in accordance with the conventional art.
Figure 4B:
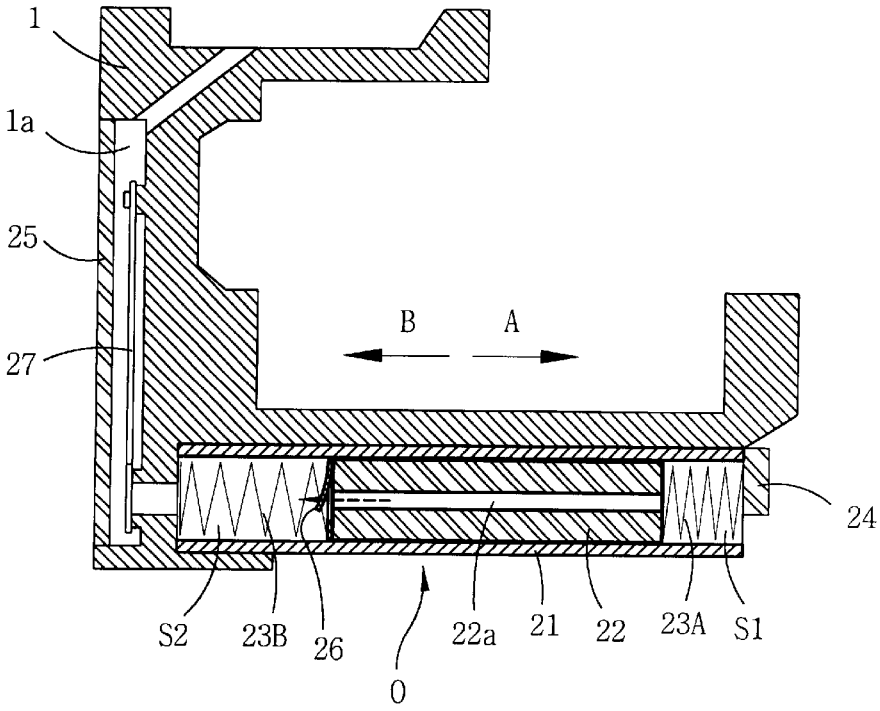
FIG. 4B CONVENTIONAL ART
FIG. 4B is a vertical-sectional view showing an operation of the oil supply unit that an oil piston is moved toward an oil suction cover in accordance with the conventional art.

In the descriptions for the drawings, the same construction elements as in FIG. 1 are given the same reference numerals, of which the same descriptions are omitted.

Figure 5:
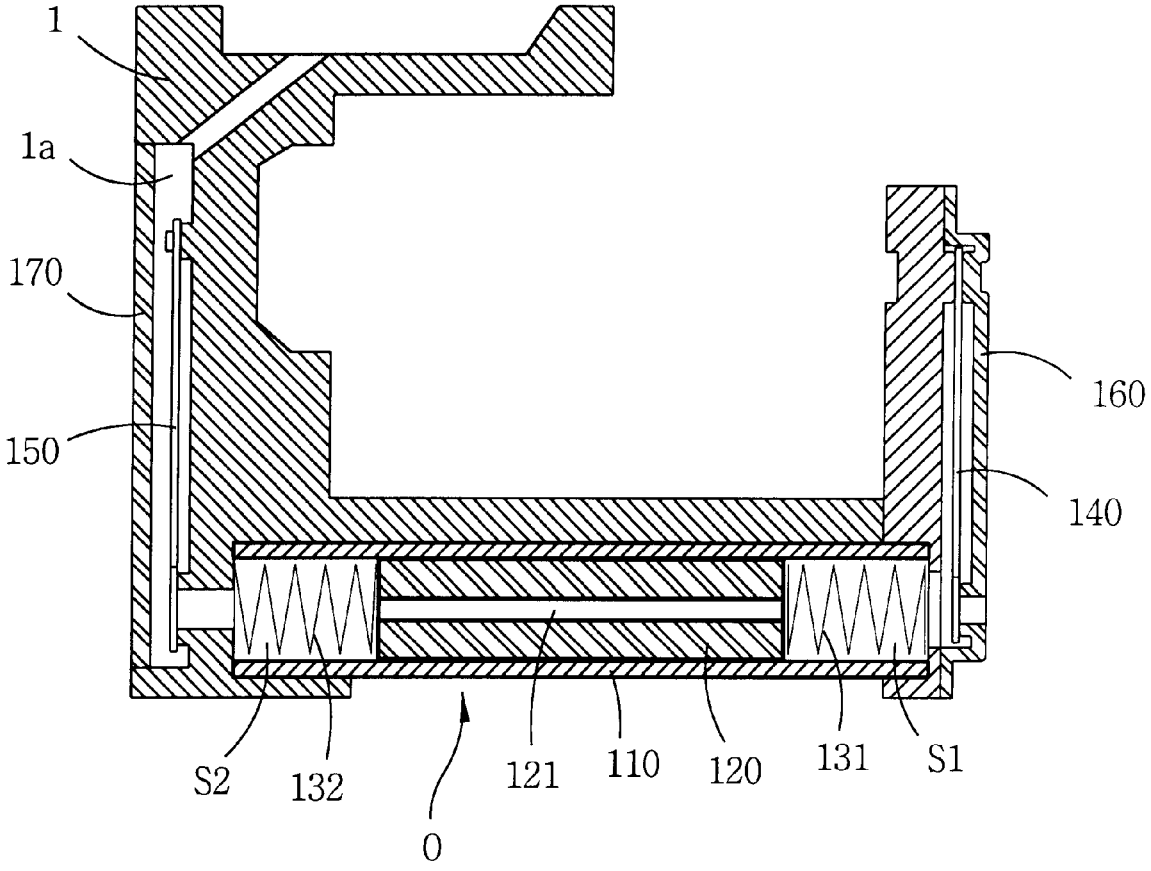
FIG. 5 is a vertical-sectional view of an oil supply unit of a linear compressor in accordance with one embodiment of the present invention.
Figure 6A:
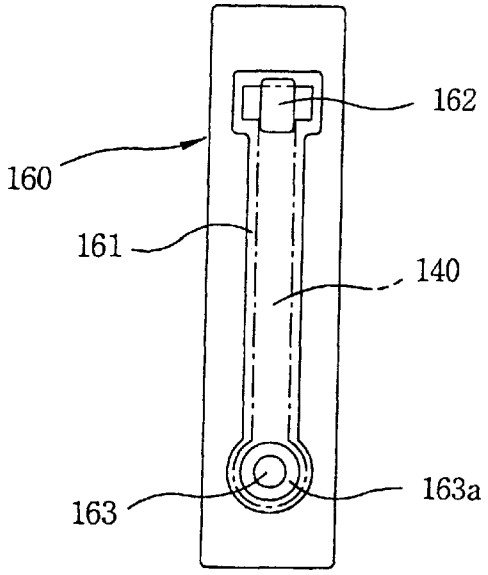
FIG. 6A is a plan view of an oil suction valve and an oil suction cover of the oil supply unit in accordance with one embodiment of the present invention.

FIG. 5 is a vertical-sectional view of an oil supply unit of a linear compressor in accordance with one embodiment of the present invention; FIG. 6A is a plan view of an oil suction valve and an oil suction cover of the oil supply unit in accordance with one embodiment of the present invention; and FIG. 6B is a vertical-sectional view of an oil suction valve and an oil suction cover of the oil supply unit in accordance with one embodiment of the present invention.

Figure 6B:
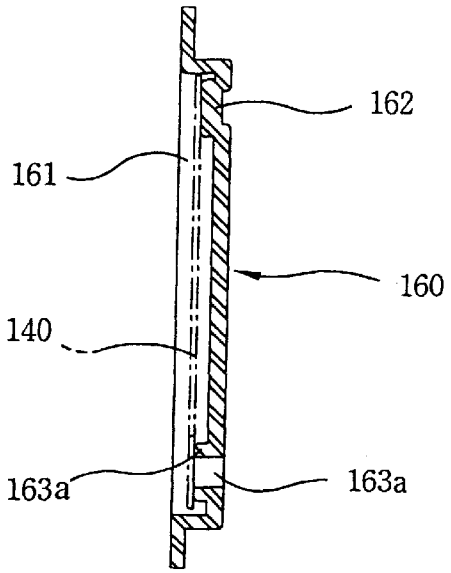
FIG. 6B is a vertical-sectional view of an oil suction valve and an oil suction cover of the oil supply unit in accordance with one embodiment of the present invention.

As shown in FIGS. 5 through 6B, an oil supply unit of a linear compressor in accordance with one embodiment of the present invention includes: an oil cylinder 110 fixed at the lower portion of the frame 1 so as to be put in the oil filling the well-closed container 'V', and being vibrated in the horizontal direction according to the reciprocal movement of the piston 3; an oil piston 120 inserted in the oil cylinder 110 in a manner of dividing the inside of the oil cylinder to a suction space S1 and a discharge space S2 that are communicated to each other, and being vibrated in the horizontal direction; a first and a second oil springs 131 and 132 for elastically supporting to both end portions of the oil piston 120, respectively; an oil suction valve 140 installed at the outer side of the suction side of the oil cylinder 110, for opening and closing the suction side of the oil cylinder 110; an oil discharge valve 150 installed at the outer side of the discharging side of the oil cylinder 110, for opening and closing the discharging side of the oil cylinder; an oil suction cover 160 for covering the suction side of the oil cylinder 110 and having the oil suction valve 140 inside thereof; and an oil discharge cover 170 forming an oil inlet passage, opening the discharging side of the oil cylinder 110, and having the oil discharge valve 150 inside thereof.

In the oil piston 120 used in one embodiment of the present invention, an oil passage 121 that communicates the suction space S1 and the discharge space S2 of the oil cylinder 110; is penetrating inserted, of which outer circumferential surface slidably contacts the inner circumferential surface of the oil cylinder 110.

The oil suction valve 140 and the oil discharge valve 150 are all formed in a rectangular form, of which each upper end portion is fixed at the compressive unit 'C' and each lower end portion is positioned to be rotatable toward the suction side and the discharging side of the oil cylinder 110. The oil suction valve 140 and the oil discharge valve 150 are opened and closed in the same direction when the oil cylinder 110 is reciprocally moved.

As shown in FIGS. 6A and 6B, the oil suction cover 160 is depressively formed in a rectangular form to have a volume unit 161 in which the oil suction valve 140 is inserted at its central portion, so that the outer surface except for the volume unit 161 is tightly fixed at the compressive unit 'C'. A fixing protrusion 162 is formed at the upper end portion of the volume unit 161 to fix the upper end portion of the oil suction valve 140. An oil suction hole 163 is formed at the lower end portion of the volume unit 161, communicating with the suction side of the oil cylinder 110. A mounting protrusion 163*a* raised in a circular form is formed at the inner side of the oil suction hole 163, corresponding to the fixing protrusion 162.

Meanwhile, the oil discharge cover 170 forms the oil inlet passage 1*a* together with the frame 1 is fixed to open the discharging side of the oil cylinder 110.

The operation of the oil supply unit of a linear compression in accordance with the present invention will now be described.

When the magnet assembly 7, the rotor of the linear motor, is linearly and reciprocally moved, the compressive unit 'C' is vibrated in the horizontal direction together with the magnet assembly. This vibration is transferred to the oil cylinder 110 of the oil supply unit 'O' fixed at the compressive unit 'C', moving the oil cylinder 110. And, the oil piston 120 inserted in the oil cylinder 110 pumps the oil by the inertial force corresponding to the reciprocal movement of the oil cylinder 110, and the pumped oil flows through the oil inlet passage 1*a* to the compressive unit 'C' and returns to the well-closed container 'V'.

The oil-pumping operation by the oil supply unit of a linear compressor in accordance with the present invention will now be described in detail.

Figure 7A:
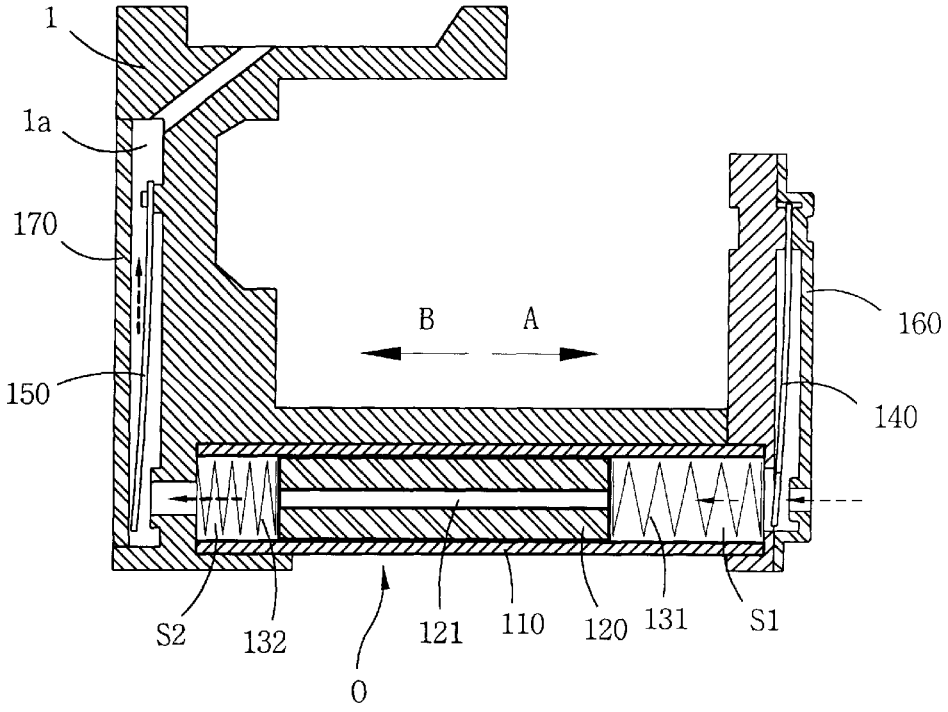
FIG. 7A is a vertical-sectional view showing an operation of the oil supply unit that an oil piston is moved toward an oil discharge cover in accordance with one embodiment of the present invention.
Figure 7B:
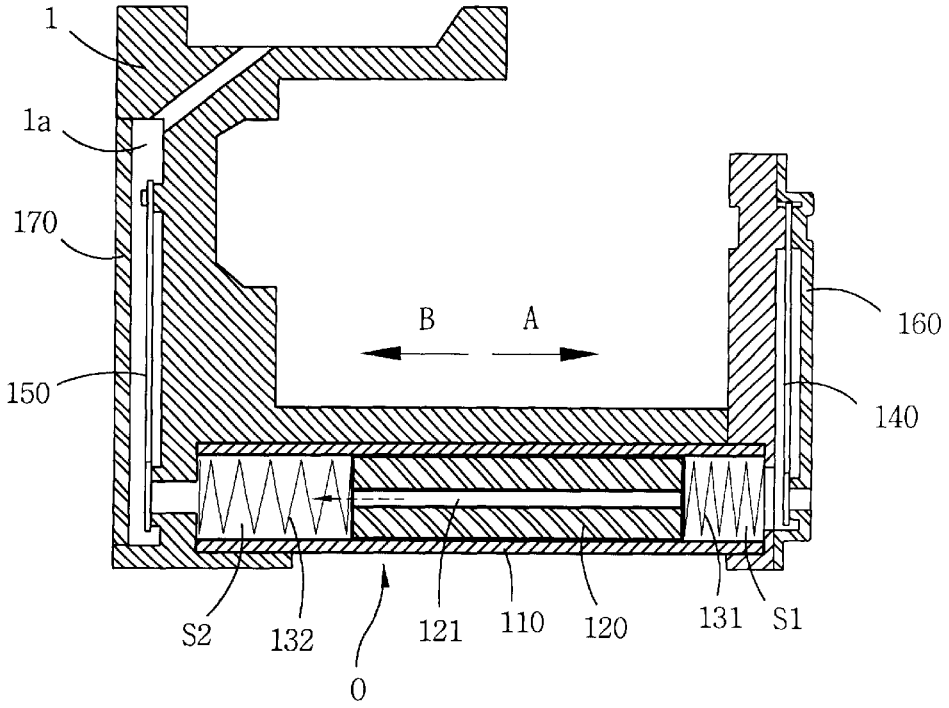
FIG. 7B is a vertical-sectional view showing an operation of the oil supply unit that an oil piston is moved toward an oil suction cover in accordance with one embodiment of the present invention.

FIG. 7A is a vertical-sectional view showing an operation of the oil supply unit that an oil piston is moved toward an oil discharge cover in accordance with one embodiment of the present invention; and FIG. 7B is a vertical-sectional view showing an operation of the oil supply unit that an oil piston is moved toward an oil suction cover in accordance with one embodiment of the present invention.

First, when the oil cylinder 110 is moved in the 'A' direction of FIG. 7A, resultantly, the oil piston 120 is moved 'B' direction, so that the oil piston 120 pushes the oil filling the discharge space S2, according to which the oil discharge valve 150 that blocks the discharging side of the oil cylinder 110 is pulled back to be opened. Meanwhile, the oil that filled the well-closed container 'V' is thrust through the oil suction hole 163 of the oil suction cover 160 so that the oil suction valve 140 that blocks the oil suction hole 163 at the inner side is pulled back in the same direction as that of the oil discharge valve 150 to be opened, according to which the oil of the well-closed container 'V' is induced to the suction space S1 of the oil cylinder 110.

Reversely, when the oil cylinder 110 is moved in the 'B' direction of FIG. 7B, resultantly, the oil piston 22 is moved in the 'A' direction, so that the pressure of the discharge space S2 becomes relatively low compared with that of the suction space S1, rendering the oil of the suction space S1 to be moved to the discharge space S2 through the oil passage 121.

At this time, the oil suction valve 140 is rotated to return to its original position, so that the oil suction hole 163 of the oil suction cover 160 is closed, and the oil discharge valve 150 is also rotated to return to its original position, so that the discharging side of the oil cylinder 110 is closed. These processes are repeatedly performed.

An oil supply unit of a linear compressor in accordance with another embodiment of the present invention will now be described.

Figure 8:
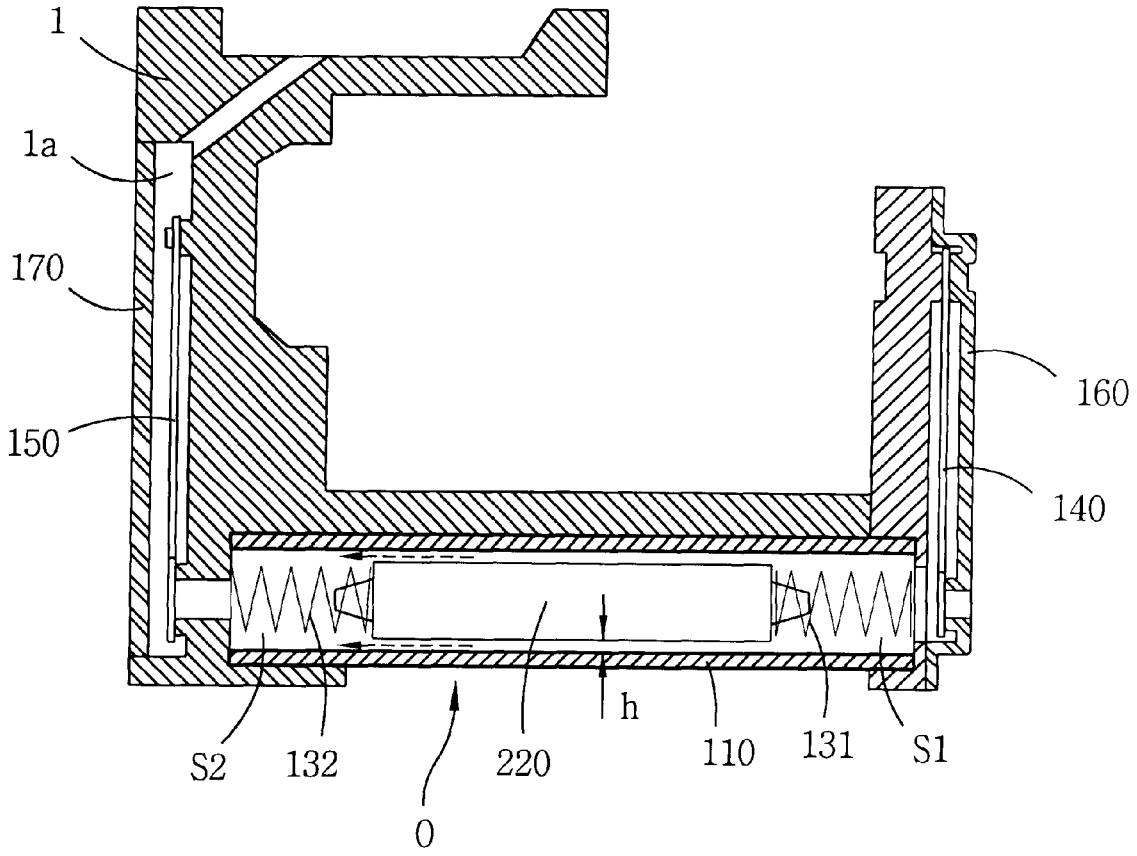
FIG. 8 is a vertical-sectional view of an oil supply unit in accordance with another embodiment of the present invention.

FIG. 8 is a vertical-sectional view of an oil supply unit in accordance with another embodiment of the present invention.

As shown in the drawing, the oil piston 220 inserted in the oil cylinder 110 is formed in a bar form without an oil passage penetrating itself at its inner central portion in a lengthy direction, so that an oil opening 'h' is formed between the outer circumferential surface thereof and the inner circumferential surface of the oil cylinder 110.

Accordingly, as the oil cylinder 110 is moved toward the oil discharging side, the pressure of the discharge space S2 becomes relatively low compared to that of the suction space S1, according to which the oil opening 'h' becomes the path through which the oil is moved from the suction space S1 to the discharge space S2.

As described above, in case where the oil discharge valve 150 and the oil suction valve 140 are installed outside the oil cylinder 110, since they can be simply formed with large size, facilitating its processing and assembling. Also, as presented in the second embodiment of the present invention, since no oil passage is required for the oil piston, the oil piston can be easily fabricated.

As so far described, according to the oil supply unit of the linear compressor of the present invention, since the oil suction valve is not mounted at the oil cylinder having a small diameter, processing and assembling of the oil suction valve are easy, so that its productivity is improved. In addition, during the operation of the oil supply unit, the oil suction valve does not contact the oil spring, so that a reliability of the compressor is highly improved.

It will be apparent to those skilled in the art that various modifications and variations can be made in the plasma polymerization on the surface of the material of the present invention without departing from the spirit or scope of the invention. Thus, it is intended that the present invention cover modifications and variations of this invention provided they come within the scope of the appended claims and their equivalents.

What is claimed is:

1. An oil supply unit of a linear compressor comprising:

a well-closed container filled with oil; a frame installed within the well-closed container;

a cylinder fixed at the frame;

a piston inserted in the cylinder and being linearly and reciprocally movable by a linear motor;

an oil cylinder fixed at a lower portion of the frame so as to be put in the oil filling the well-closed container, and being vibrated in the horizontal direction according to the reciprocal movement of the piston;

an oil piston inserted in the oil cylinder in a manner of dividing the inside of the oil cylinder to a suction space and a discharge space that communicate with each other, and being vibrated in the horizontal direction;

an oil suction unit installed at an outer side of the suction side of the oil cylinder;

an oil discharge valve installed at the outer side of the discharging side of the oil cylinder;

wherein the oil suction valve is rectangular in form, of which an upper end portion is fixed at the frame and a lower end portion is rotatably positioned in the suction side direction of the oil cylinder; and wherein the oil suction unit includes an oil suction valve for opening and closing the suction side of the oil cylinder, and an oil suction cover for covering the suction side of the oil cylinder and having the oil suction valve inside thereof.

2. The oil supply unit according to claim 1, wherein an oil passage that communicates the suction space and the discharge space of the oil cylinder, is penetratingly inserted in the oil piston, of which outer circumferential surface slidably contacts the inner circumferential surface of the oil cylinder.

3. The oil supply unit according to claim 1, wherein the oil piston inserted in the oil cylinder is formed in a bar form without an oil passage penetrating itself at its inner central portion in a longitudinal direction, so that an oil opening 'h' is formed between an outer circumferential surface thereof and an inner circumferential surface of the oil cylinder.

4. The oil supply unit according to claim 2, wherein both ends of the oil piston are elastically supported as being contacted with a compressive coil spring, respectively.

5. The oil supply unit according to claim 2, wherein the oil passage becomes a path through which the oil is moved from the suction space to the discharge space.

6. The oil supply unit according to claim 3, wherein both ends of the oil piston are elastically supported as being contacted with a compressive coil spring, respectively.

7. The oil supply unit according to claim 3, wherein the oil opening becomes a path through which the oil is moved from the suction space to the discharge space.

8. The oil supply unit according to claim 1, wherein the oil discharge unit includes an oil discharge valve for opening and closing the discharge side of the oil cylinder, and an oil discharge cover for forming an oil inlet passage covering the discharge side of the oil cylinder, and having the oil discharge valve inside thereof.

9. An oil supply unit of a linear compressor comprising:

a well-closed container filled with oil;

a frame installed within the well-closed container;

a cylinder fixed at the frame;

a piston inserted in the cylinder and being linearly and reciprocally moved by a linear motor;

an oil cylinder fixed at a low portion of the frame so as to be put in the oil filling the well-closed container, and being vibrated in the horizontal direction according to the reciprocal movement of the piston;

an oil piston inserted in the oil cylinder is a manner of dividing the inside of the oil cylinder to a suction space and a discharge space that are communicated to each other, and being vibrated in the horizontal direction;

an oil suction unit installed at an outer side of the oil cylinder;

an oil discharge valve installed at the outer side of the discharging side of the oil cylinder;

wherein the oil discharge unit includes an oil discharge valve for opening and closing the discharge side of the oil cylinder, and an oil discharge cover for forming an oil inlet passage covering the discharge side of the oil cylinder, and having the oil discharge valve inside thereof; and wherein the oil discharge valve is formed in a rectangular form, of which an upper end portion is fixed at the frame and a lower end portion thereof is rotatably positioned in the discharging side-direction of the oil cylinder.

10. An oil supply unit of a linear compressor comprising:

a well-closed container filled with oil; a frame installed within the well-closed container;

a cylinder fixed at the frame;

a piston inserted in the cylinder and being linearly and reciprocally moved by a linear motor;

an oil cylinder fixed at a lower portion of the frame so as to be put in the oil filling the well-closed container, and being vibrated in the horizontal direction according to the reciprocal movement of the piston;

an oil piston inserted in the oil cylinder in a manner of dividing the inside of the oil cylinder to a suction space and a discharge space that are communicated to each other, and being vibrated in the horizontal direction;

an oil suction unit installed at an outer side of the oil cylinder;

an oil discharge valve installed at the outer side of the discharging side of the oil cylinder;

wherein the oil suction unit includes an oil suction valve for opening and closing the suction side of the oil cylinder, and an oil suction cover for covering the suction side of the oil cylinder and having the oil suction valve inside thereof;

wherein an oil suction hole communicating with the suction side of the oil cylinder is formed at the oil suction cover, which is opened and closed by the oil suction valve; and wherein the oil suction cover is depressively formed in a rectangular form to have a volume unit in which the oil suction valve is inserted at its central portion, so that the outer surface except for the volume unit is tightly fixed at the compressive unit, a fixing protrusion is formed at the upper end portion of the volume unit to fix the upper end portion of the oil suction valve, and a mounting protrusion raised in a circular form is formed at the inner side of the oil suction hole, corresponding to the fixing protrusion.

* * * * *